US005189757A

United States Patent [19]

Williams et al.

[11] Patent Number: 5,189,757

[45] Date of Patent: Mar. 2, 1993

[54] HEAD ASSEMBLY FOR A VACUUM CLEANING APPARATUS

[76] Inventors: William H. Williams, 4938 Golden Arrow, Palos Verdes, Calif. 90274; Paul G. Jacobs, 9958 Amestoy Ave., Northridge, Calif. 91324

[21] Appl. No.: 784,306

[22] Filed: Oct. 31, 1991

[51] Int. Cl.[5] ..... A47L 5/30

[52] U.S. Cl. ..... 15/332; 15/323; 15/416

[58] Field of Search ..... 15/331, 332, 416

[56] References Cited

U.S. PATENT DOCUMENTS

| | | | |
|---|---|---|---|
| 1,470,894 | 10/1923 | Throop | 15/416 X |
| 1,726,592 | 9/1929 | Spanel | 15/332 |
| 2,348,861 | 5/1944 | Smellie | 15/331 X |
| 4,179,768 | 12/1979 | Sawyer | 15/352 |
| 4,809,397 | 3/1989 | Jacobs et al. . | |
| 4,951,346 | 8/1990 | Salmon | 15/331 X |
| 4,976,003 | 12/1990 | Williams . | |
| 5,008,973 | 4/1991 | Worwag | 15/331 X |
| 5,012,549 | 5/1991 | Williams et al. . | |
| 5,054,158 | 10/1991 | Williams et al. . | |

FOREIGN PATENT DOCUMENTS

| | | | |
|---|---|---|---|
| 391578 | 5/1933 | United Kingdom | 15/331 |

*Primary Examiner*—Chris K. Moore
*Attorney, Agent, or Firm*—Kelly, Bauersfeld & Lowry

[57] ABSTRACT

A cleaning head assembly for a vacuum cleaning apparatus of the wet, dry and wet/dry types includes a rotatably driven brush carried within and laterally spanning the head assembly. A first vacuum chamber extends through the cleaning head assembly from a first inlet opening adjacent to a surface to be cleaned and laterally spanning the head assembly on one side of the brush, to a first exhaust port. A second vacuum chamber extends through the cleaning head assembly from a second inlet opening adjacent to the surface to be cleaned and laterally spanning the head assembly on a second, opposite, side of the brush relative to the first inlet opening, to a second exhaust port. A slidable gate valve selectively couples one end of a flexible hose to one of the exhaust ports for selective vacuuming of debris through either the first or the second inlet openings. The brush is automatically rotated in a direction which assists in propulsion of the vacuum cleaning apparatus across the surface to be cleaned so that the inlet opening through which debris is being sucked up, follows the brush. As the slidable gate valve is repositioned from one exhaust port to another, the direction of brush rotation is automatically changed.

20 Claims, 5 Drawing Sheets

FIG. 1
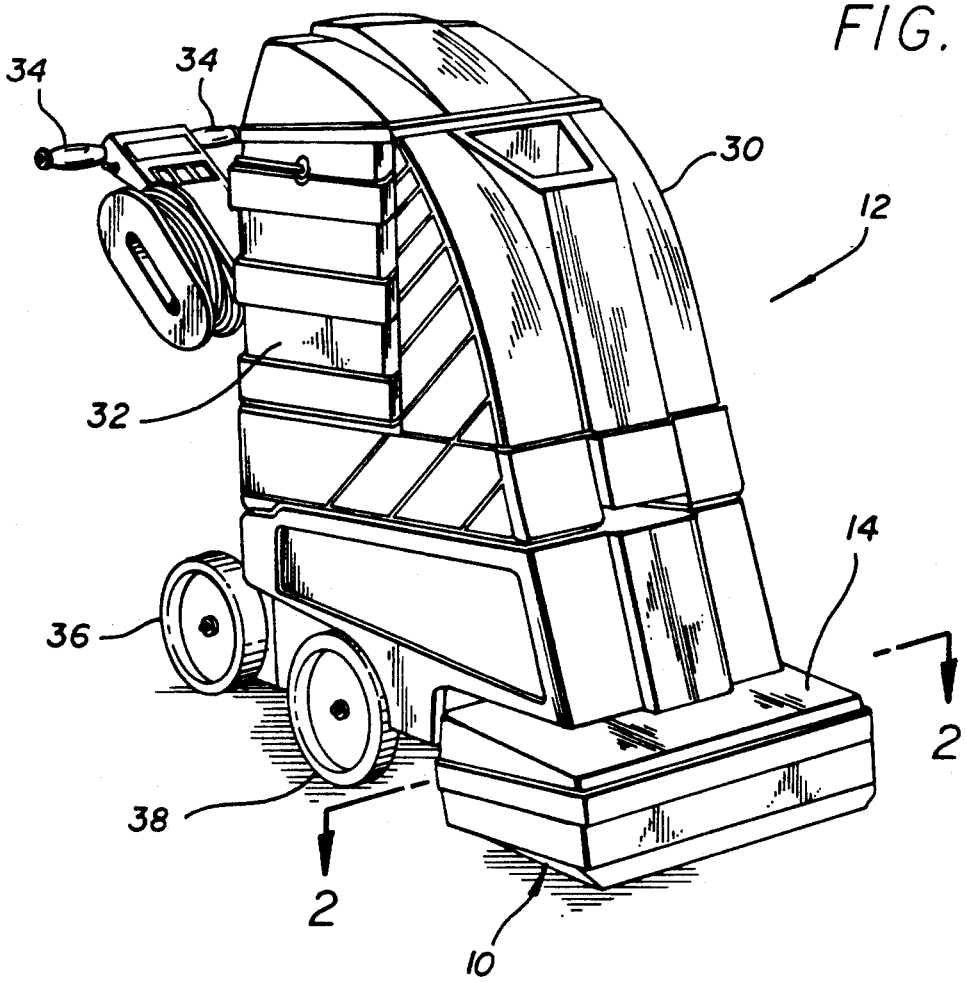
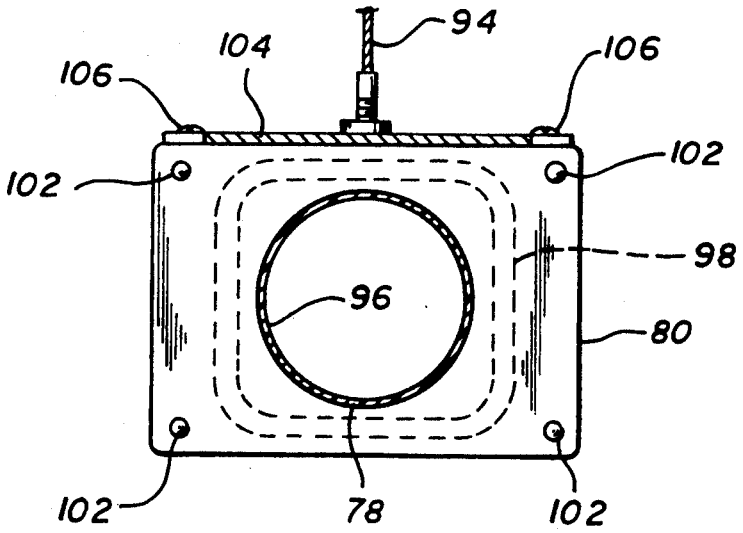
FIG. 5

HEAD ASSEMBLY FOR A VACUUM CLEANING APPARATUS

BACKGROUND OF THE INVENTION

This invention relates generally to cleaning devices. More specifically, the present invention relates to an improved cleaning head assembly for a vacuum cleaning apparatus of the wet, dry and wet/dry types.

Many prior devices for cleaning rugs, carpets and the like have consisted basically of a system for delivering cleaning solution (usually a hot aqueous detergent solution) to the rug or carpet, and a system for vacuuming the applied cleaning solution from the rug or carpet. Many such "vacuum cleaners" or carpet cleaning machines have been provided with a rotatable brush which is intended to contact and brush the and debris so that it can be sucked up into a collection tank or bag by a vacuum motor. The brush is able to perform its intended purpose only to the extent the distal ends of the bristles of the brush are in contact with the surface being cleaned. Keeping the brush in contact is not a problem provided the surface being cleaned is absolutely uniform, smooth and level. However, in many cases, the surface is irregular or bumpy. When this irregular surface condition exists, the efficiency of the brush is diminished, since only some of the bristles can contact the surface being cleaned. One of the best devices for maintaining contact between the brush and the surfaces being cleaned where the surface is irregular is shown in U.S. Pat. No. 4,976,003, entitled CLEANING APPARATUS, and issued to one of the inventors herein.

A typical vacuum system for a carpet cleaning device generally comprises a vacuum chamber or nozzle disposed in a cleaning head assembly which is positioned over the rug, carpet or the like to "suck up" applied cleaning solution, dirt and other debris, and a vacuum pump in fluid communication with the cleaning head assembly to generate a partial vacuum therein. There are two variations of the basic system found in the marketplace. In one embodiment, the cleaning head, the solution delivery system, the vacuum system, and one or more solution tanks are integrated into a single wheeled housing which is pulled over the rug or carpet by the operator. In the other embodiment, the cleaning head is a separate unit from a wheeled housing containing the vacuum system, the solution delivery system and the solution tanks. Both embodiments have advantages and disadvantages. For example, the cleaning unit having a separate cleaning head is easier to manipulate over a rug or carpet surface, but because of the additional distance the fresh solution must be pumped to the cleaning head and the spent solution must be transferred back to the housing after the aspiration thereof from the rug or carpet, the power requirements for both the solution pump and the vacuum pump are substantially increased. Moreover, the connections for the tubings for the separate cleaning head present maintenance problems because they frequently leak solution.

The cleaning devices which are completely contained within a wheeled housing are most desirable from a manufacturing and maintenance point of view, but they are more difficult to move over a rug or carpet surface during the cleaning operation, especially where space is limited, for example in small offices or narrow hallways. As a result, their use has been limited to professional or commercial rug and carpet cleaners. Moreover, they tend to be larger and heavier than non-industrial units.

Accordingly, there has been a need for a novel vacuum cleaning apparatus of the wet, dry and wet/dry types having a proven, durable construction, which can be easily maneuvered over a surface to be cleaned during the cleaning operation, and is constructed in a manner improving the utility of the vacuum cleaning apparatus over prior devices. In this regard, it is noted that prior industrial vacuum cleaning devices formed as an integral unit have been designed wherein they must be pulled by the operator to ensure that dirt and debris loosened from the surface to be cleaned by the cleaning brush is sucked up into the vacuum chamber. This required the cleaning apparatus to be turned 180° every time an opposite wall was encountered in order to ensure adequate cleaning coverage. There therefore exists a need for a novel cleaning head assembly for use in a vacuum cleaning apparatus which permits the apparatus to be either pushed or pulled and yet provide means for adequately sucking up debris loosened by the cleaning brush without reducing the vacuum drawn through the cleaning head. Additionally, an improved cleaning head assembly is needed which assists in propulsion of the cleaning apparatus across the surface to be cleaned, in both the push and pull directions. The present invention fulfills these needs and provides other related advantages.

SUMMARY OF THE INVENTION

The present invention resides in an improved cleaning head assembly for a vacuum cleaning apparatus, which assembly not only assists in propulsion of the cleaning apparatus across a surface to be cleaned, but also ensures uniform cleaning of that surface. The improved cleaning head assembly is useful in industrial vacuum cleaners wherein the cleaning head and the vacuum system are integrated into a single wheeled housing which is pulled over a rug, carpet or other surface to be cleaned by the operator. The head assembly of the present invention is particularly useful when such industrial units are utilized to clean small offices or narrow hallways, where space to maneuver the cleaning apparatus is limited.

The cleaning head assembly comprises, generally, a brush carried within and laterally spanning the head assembly. The brush is adapted to loosen and agitate dirt on a surface to be cleaned, in much the same manner as conventional cleaning brushes. Vacuum means communicating with the cleaning head assembly are provided for sucking up debris and carrying it to a collection zone within the vacuum cleaning apparatus. The vacuum means includes a first vacuum pathway having a first inlet opening adjacent to the surface to be cleaned and laterally spanning the head assembly on one side of the brush, and a second vacuum pathway having a second inlet opening adjacent to the surface to be cleaned and laterally spanning the head assembly on a second, opposite, side of the brush relative to the first inlet opening. Means are also provided for drawing a vacuum through one of the first or the second vacuum pathways, as selected by an operator of the vacuum cleaning apparatus.

In a preferred form of the invention, a motor is provided for rotatably driving the brush in a direction intended to assist in propelling the vacuum cleaning apparatus across the surface to be cleaned. A first vacuum chamber extends through the cleaning head assembly from the first inlet opening to a first exhaust port, and a second vacuum chamber extends through the cleaning head assembly from the second inlet opening to a second exhaust port. A common vacuum passageway, including a flexible hose, extends from the cleaning head assembly to the dirt collection zone. The flexible hose is connectable to the first and the second exhaust ports to form a portion of the first and the second vacuum pathways, respectively.

The means for selectively drawing a vacuum through the first or the second vacuum pathways includes means for selectively placing the common vacuum passageway in fluid communication with one of the first or the second vacuum chambers. More specifically, a proximal end of the flexible hose is connected to a gate valve positioned adjacent to the exhaust ports. The gate valve is slidable between a first position in which the proximal end of the flexible hose is coupled to the first exhaust port, and a second position in which the proximal end of the flexible hose is coupled to the second exhaust port.

Means are provided for biasing the gate valve into is first position, wherein the vacuum means sucks up debris through the first inlet opening. Means are also provided for forcibly displacing the gate valve into the second position to permit the vacuum means to suck up debris through the second inlet opening in the cleaning head. The biasing means includes a spring which constantly urges the slidable gate valve into its first position. A pull cable connects the gate valve to a solenoid which can be actuated to forcibly displace the gate valve from its first position to its second position.

Additionally, means are provided for controlling the motor to rotate the brush in a direction as determined by the vacuum pathway selected. The brush rotation controlling means includes a delay which permits, upon a switch from one vacuum pathway to the other, the brush to slow or stop its rotation in a first direction before being forcibly rotatably driven in a second direction. The brush is preferably rotated in a direction tending to propel the vacuum cleaning apparatus so that the inlet opening through which the vacuum means is sucking up debris, follows the rotating brush.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of an exemplary vacuum cleaning apparatus having the cleaning head assembly of the present invention;

FIG. 5 is a vertical section taken generally along the line 5—5 of FIG. 3, showing details of a slidable gate.

DETAILED DESCRIPTION OF THE PREFERRED EMBODIMENT

Figure 2:
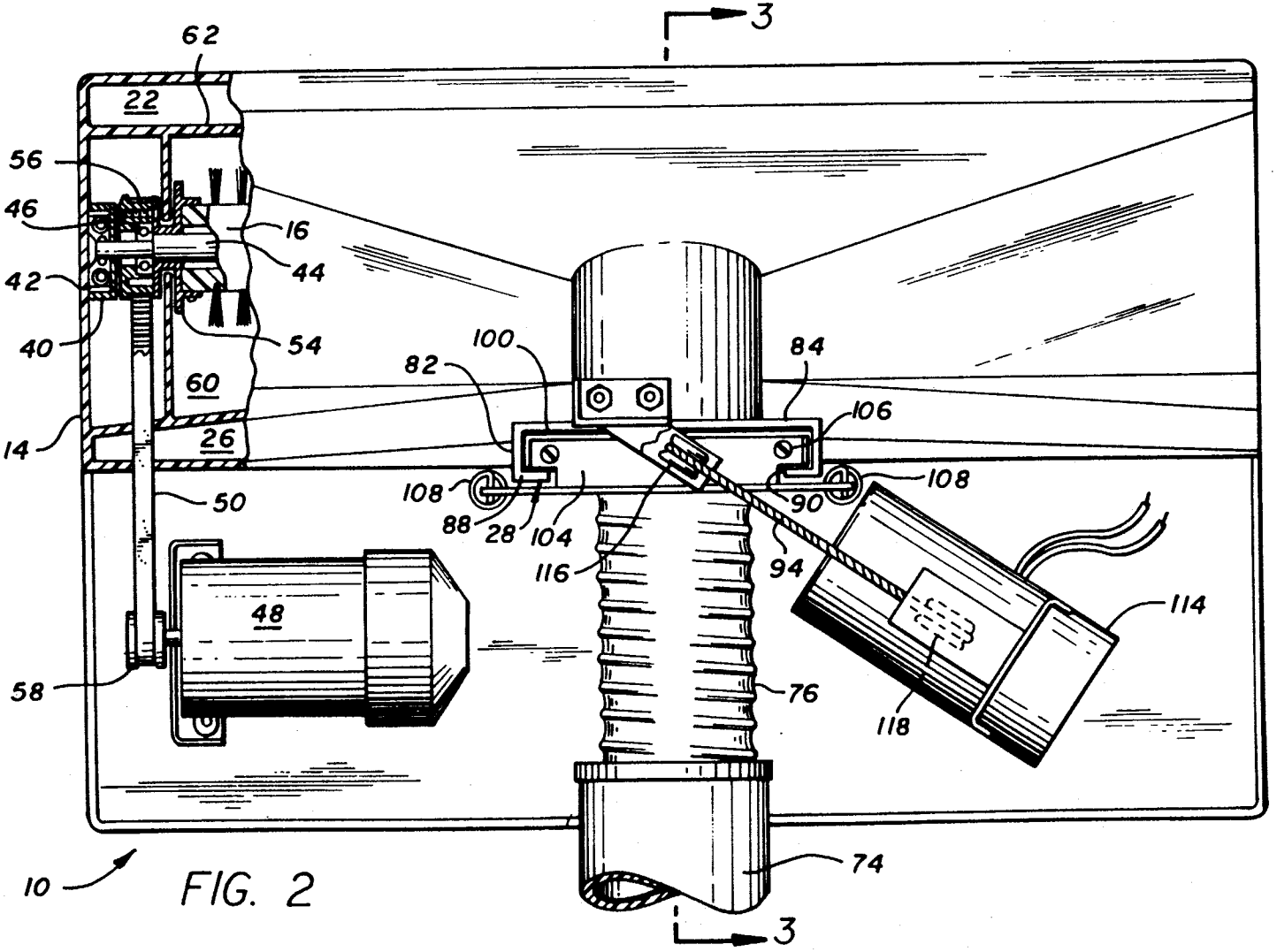
FIG. 2 is an enlarged partially fragmented sectional plan view of the cleaning head assembly, taken generally along the line 2—2 of FIG. 1, illustrating the manner in which a cleaning brush is driven by an electric motor, and further illustrating the manner in which the position of a slidable gate valve is determined through actuation of a solenoid.

As shown in the drawings for purposes of illustration, the present invention is concerned with an improved cleaning head assembly, generally designated in FIGS. 1–4 by the reference number 10, designed for use in connection with a vacuum cleaning apparatus 12. The cleaning head assembly 10 comprises a housing 14 and a brush 16 carried within and laterally spanning the housing. The brush 16 is adapted to loosen and agitate dirt on a surface 18 to be cleaned. Vacuum means are provided within the vacuum cleaning apparatus 12, which communicate with the cleaning head assembly 10 for sucking up debris and carrying it to a collection zone within the vacuum cleaning apparatus. The vacuum means includes a first vacuum pathway 20 having a first inlet opening 22 adjacent to the surface 18 to be cleaned and laterally spanning the head assembly 10 on one side of the brush 16. The vacuum means also includes a second vacuum pathway 24 having a second inlet opening 26 adjacent to the surface 18 to be cleaned and laterally spanning the head assembly 10 on a second, opposite, side of the brush 16 relative to the first inlet opening 22. A slidable gate valve 28 provides means for selectively drawing a vacuum through one of the first or the second vacuum pathways 20 and 24, as determined by the position of the gate valve.

In a preferred form of the invention, and with reference to FIG. 1, the vacuum cleaning apparatus 12 includes an upper body 30 which carries removable water tanks 32 and handles 34 at the top rear. The upper body 30 encloses a vacuum motor (not shown) which is carried on a frame chassis by four wheels. The rear wheels 36 are rotatably connected to the cleaning apparatus 12, but are otherwise fixed in that they cannot move up and down relative to the rest of the machine. The front wheels 38 preferably can move relative to the upper body 30. The structure of the upper portion of the cleaning apparatus 12 is more fully disclosed in U.S. Pat. No. 5,012,549, issued May 7, 1991, which is incorporated herein by reference. The structure of the chassis and wheels of the cleaning apparatus 12 is more fully disclosed in U.S. Pat. No. 5,054,158, issued Oct. 8, 1991, which is also incorporated herein by reference.

Figure 3:
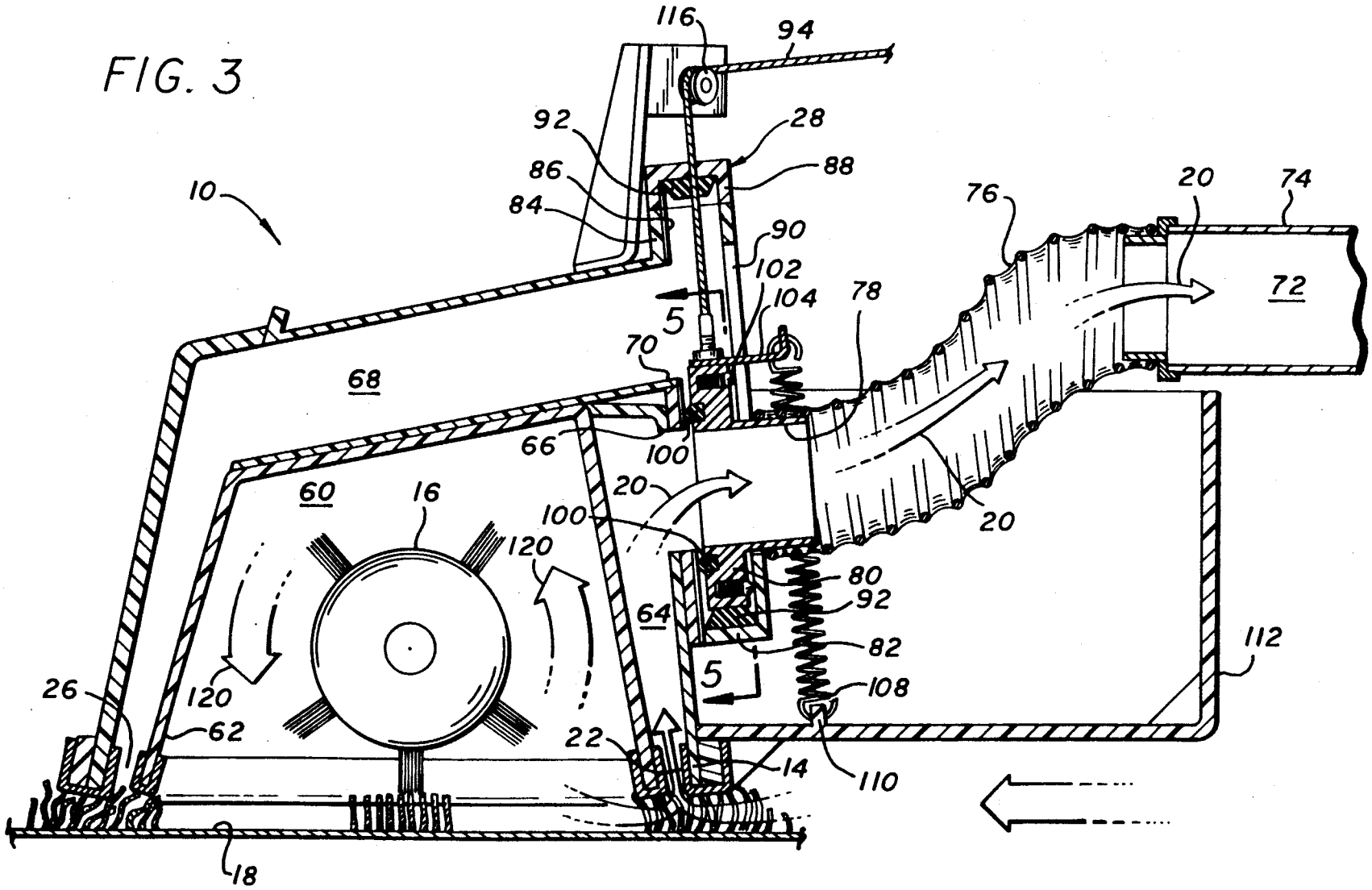
FIG. 3 is a fragmented vertical section taken generally along the line 3—3 of FIG. 2, illustrating the position of the slidable gate valve to couple a flexible hose leading to a dirt collection zone within the vacuum cleaning apparatus, to a first exhaust port to define a first vacuum pathway through the cleaning head assembly.
Figure 4:
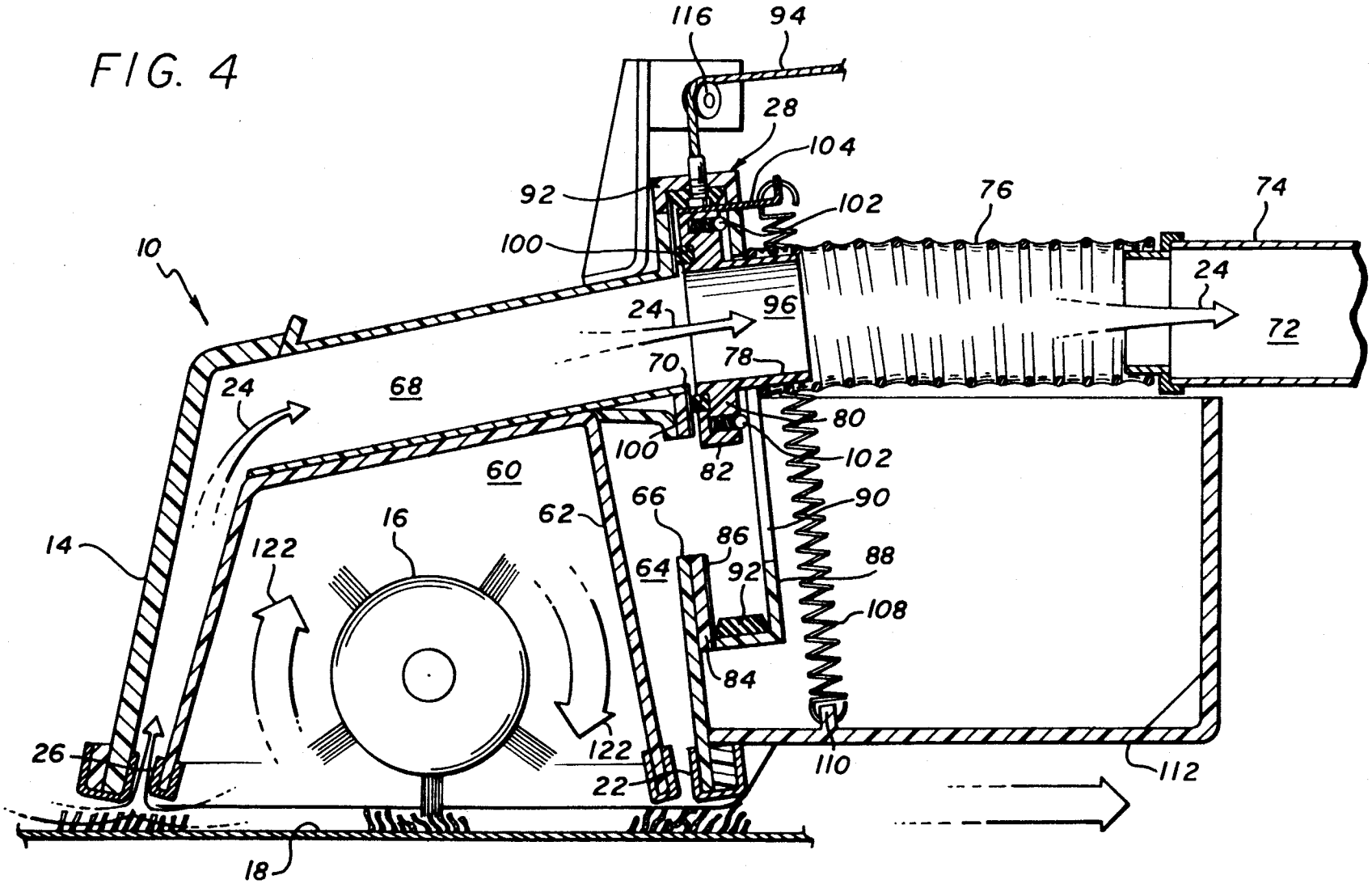
FIG. 4 is a fragmented vertical section similar to FIG. 3, illustrating the position of the slidable gate valve to couple the flexible hose to a second exhaust port, thereby defining a second vacuum pathway through the cleaning head assembly.

The cleaning head assembly 10 extends from the front of the cleaning apparatus 12 and is normally raised up slightly from the floor surface 18 when all four wheels are resting on the floor. In use, as shown in FIGS. 1, 3 and 4, the rear wheels 36 are raised off the floor 18 when the operator lifts up on the handles 34. Simultaneously, the cleaning head assembly 10 is brought down to rest on the surface 18 to be cleaned in abutting relationship. At this point, the weight of the vacuum cleaning apparatus 12 rests on the front wheels 38 and on the cleaning head assembly 10.

With reference to FIG. 2, the cleaning head assembly 10, and specifically the housing 14, has affixed thereto a pair of shaft block retainer cases 40 in which shaft blocks 42 are slidably received. A shaft 44 of the brush 16 is slip fitted into the shaft blocks 42. The brush 16 is rotatably carried by the shaft 44 on ball bearings 46.

The brush 16 is driven by a brush drive motor 48 via a timing belt 50. The brush 16 has a solution slinger and string guard combinations 54 on each end. The timing belt 50 runs over a brush pulley 56 and a brush motor pulley 58.

The structure of the brush 16, the shaft blocks 42 and related components of the cleaning head assembly 10 is more fully disclosed in U.S. Pat. No. 4,976,003, issued Dec. 11, 1990, the contents of which are incorporated herein by reference.

In accordance with the present invention, and with reference to FIGS. 2–5, the brush 16 is situated within a brush chamber 60 defined by an inner housing 62 of the cleaning head assembly 10. The inner housing 62 separates the brush chamber 60 from the first and the second vacuum pathways 20 and 24. A rearwardly disposed lower end of the inner housing 62 cooperatively defines, with an adjacent lower end of the housing 14, the first inlet opening 22. Similarly, a forwardly disposed lower end of the inner housing 62 cooperatively defines, with an adjacent lower end of the housing 14, the second inlet opening 26.

A first vacuum chamber 64 is provided within the cleaning head assembly 10 in open fluid communication with the first inlet opening 22, and defines a portion of the first vacuum pathway 20. A first exhaust port 66 is provided through a rearward wall of the housing 14 to provide access to the first vacuum chamber 64 and permit the vacuum means of the vacuum cleaning apparatus 12 to be coupled to the first vacuum chamber to suck up debris through the first inlet opening 22.

A second vacuum chamber 68 is provided within the cleaning head assembly 10 in open fluid communication with the second inlet opening 26, and defines a portion of the second vacuum pathway 24. A second exhaust port 70 is provided through a rearward wall of the housing 14, to provide access to the second vacuum chamber 68 and permit the vacuum means of the vacuum cleaning apparatus 12 to be coupled to the second vacuum chamber 68 to suck up debris through the second inlet opening 26. Preferably the second exhaust port 70 is immediately adjacent to the first exhaust port 66, to permit the gate valve 28 to be selectively positioned in order to permit a partial vacuum to be drawn through either the first or the second vacuum chambers 64 and 68.

A common vacuum passageway 72 extends generally from the cleaning head assembly 10 to a dirt collection zone within the vacuum cleaning apparatus 12. As illustrated, the common vacuum passageway 72 comprises a section of piping 74 and a flexible hose 76 attached at one end to the piping 74 and at another end to a connection nipple 78 of the gate valve 28. The common vacuum passageway 72 and the first vacuum chamber 64 define the first vacuum pathway 20 extending from the first inlet opening 22, through the first exhaust port 66, to the dirt collection zone within the vacuum cleaning apparatus 12. The common vacuum passageway 72 and the second vacuum chamber 68 collectively define the second vacuum pathway 24 which extends from the second inlet opening 26, through the second exhaust port 70 to the dirt collection zone within the vacuum cleaning apparatus 12.

The gate valve 28 comprises, generally, a plate 80 slidable within a valve housing 82 fixed to a rearward wall of the housing 14 over the first and the second exhaust ports 66 and 70. The slidable plate 80 is movable between a first position (FIG. 3) in which the proximal end of the flexible hose 76 is coupled to the first exhaust port 66, and a second position (FIG. 4) in which the proximal end of the flexible hose is connected to the second exhaust port 70.

The valve housing 82 includes a front wall 84 having apertures therein corresponding to and aligned with the exhaust ports 66 and 70. The inner surface of the front wall 84 is lined with a teflon lining 86 to facilitate sliding movement of the plate 80 thereon and the formation of a seal as to be discussed in greater detail below. The valve housing 82 further includes a back wall 88 having an elongated aperture 90 through which the connection nipple 78 extends. The aperture 90 accommodates the full range of movement of the connection nipple 78 as the plate 80 is displaced between its first position and its second position. Flexibly resilient bumpers 92 are fixed to the upper and lower inner surfaces of the valve housing 82 to provide stops for the plate 80. Additionally, a gap is provided in the upper end of the valve housing 82 to permit a pull cable 94 attached to the slidable plate 80, to extend out from the valve housing 82 to a suitable valve control mechanism.

The slidable plate 80 (FIG. 5) is generally rectangular and includes a central aperture 96 defined by the connection nipple 78. A groove 98 circumscribes the central aperture 96, and a gasket 100 is positioned within the grove 98 to engage the teflon lining 86 on the front wall 84. The gasket 100 creates a seal around the central aperture 96 of the plate 80. The forward face of the plate 80, and particularly the gasket 100, is biased toward the teflon lining 86 by means of four spring loaded balls 102 which bear against the back wall 88 of the valve housing 82. Additional compressive force is exerted between the gasket 100 and the inner surface of the front wall 84 of the valve housing 82, by utilizing a wire-reinforced flexible hose 76 which is slightly compressed prior to being attached between the piping 74 and the connection nipple 78.

A bracket 104 is fixed to the top of the plate 80 by means of two screws 106 and extends rearwardly through the elongated aperture 90. Two springs 108 are attached to the bracket 104 and extend downwardly therefrom on both sides of the connection nipple 78 and the flexible hose 76 to anchors 110 provided within the body 112 of the vacuum cleaning apparatus 12. The springs 108 bias the slidable plate 80 into its first position, thus requiring forcible displacement of the plate from the first position to the second position.

In order to forcibly displace the plate 80 from its first position, wherein the common vacuum passageway 72 is placed in open communication with the first vacuum chamber 64, upwardly to its second position, the plate 80 is attached, by means of the pull cable 94, to a solenoid 114 which can be electrically actuated. More particularly, the pull cable 94 extends upwardly and outwardly from the valve housing 82 to a first roller cable guide 116, then to a second roller cable guide 118, and from there the distal end of the pull cable is attached to an actuator arm of the solenoid 114. When the solenoid 114 is not actuated, the arm thereof is extended, permitting the springs 108 to pull the slidable plate 80 downwardly into its first position. However, when the solenoid 114 is actuated, the actuator arm is drawn within the solenoid which, through the pull cable 94, draws the slidable plate 80 upwardly through the valve housing 82 into its second position to place the common vacuum passageway 72 into open fluid communication with the second vacuum chamber 68. It should be apparent to one of ordinary skill in the art that the solenoid 114 can be deleted and replaced with a manual pull cable handle and block, wherein the plate 80 position can be controlled manually.

A feature of the present invention is to provide means for controlling the brush drive motor 48 so as to rotate the brush 16 in a direction as determined by the vacuum pathway selected and to assist in propulsion of the vacuum cleaning apparatus 12 over the surface 18 to be cleaned. As illustrated in FIG. 3, the brush 16 preferably rotates in a first direction as indicated by the arrows 120 to pull the vacuum cleaning apparatus 12 in a forwardly direction as debris loosened by the brush is vacuumed through the first inlet opening 22. As illustrated in FIG. 4, the brush 16 is preferably caused to rotate in an opposite direction as indicated by the arrows 122 so as to propel the vacuum cleaning apparatus 12 in a rearward direction when the vacuum is being drawn through the second vacuum pathway 24 and, thus, the second inlet opening 26. It should be noted that it is preferred that the inlet opening through which dirt, debris and the like is collected, follows the brush 16.

Figure 6:
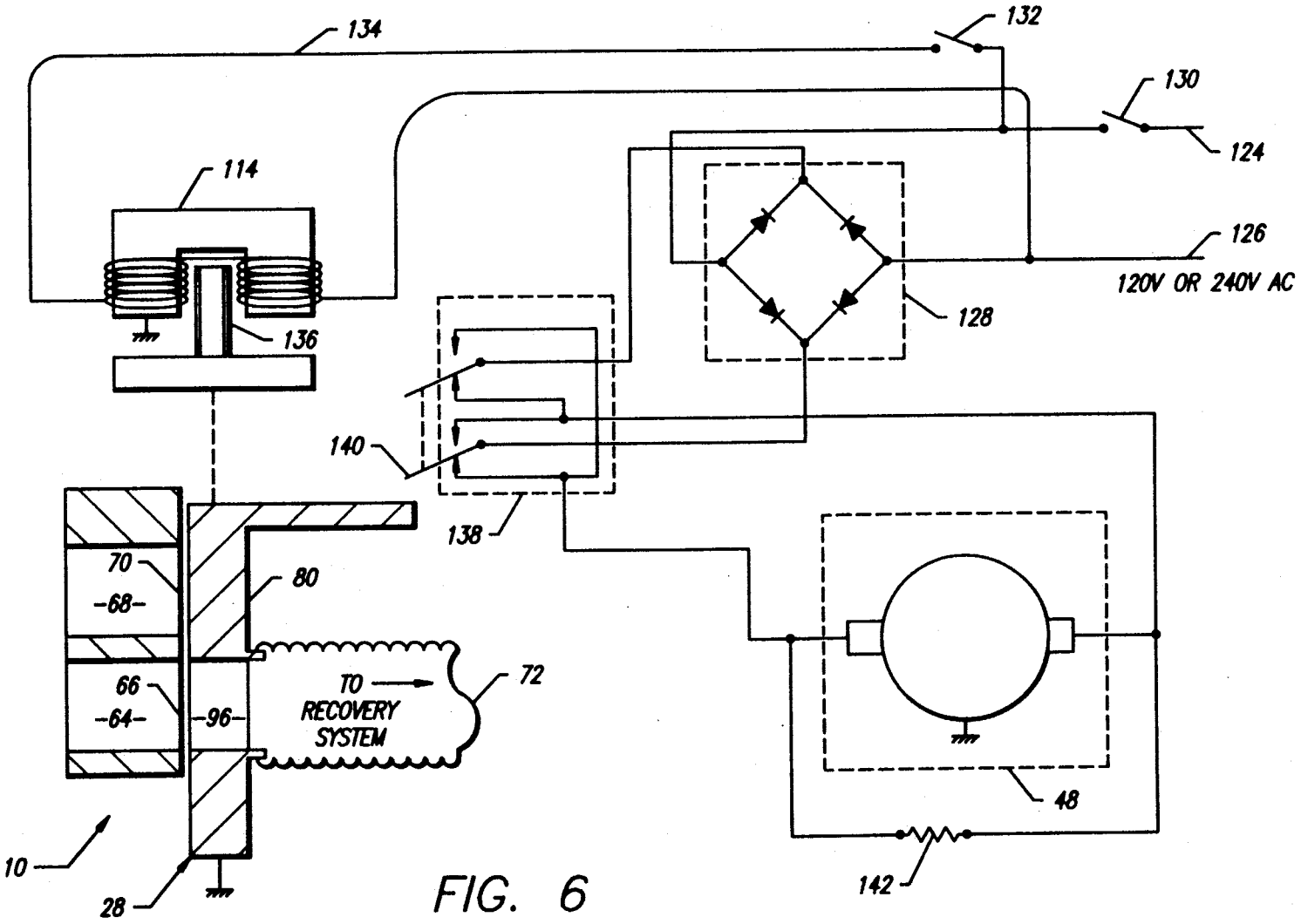
FIG. 6 is a schematic electrical diagram illustrating the manner in which the direction of rotation of the brush is automatically determined and controlled through the positioning of the gate valve.

FIG. 6 illustrates the manner in which the direction of brush rotation is controlled by the positioning of the slidable plate 80 of the gate valve 28. As shown, a 120 volt or a 240 volt alternating current power supply is provided the vacuum cleaning apparatus 12 through two leads 124 and 126. Each of these leads is connected to, respectively, the solenoid 114 and a rectifier 128 which transforms the alternating current into a direct current. A first switch 130 is provided in lead wire 124 to control power input to the cleaning head assembly 10, and specifically to the brush drive motor 48 and the solenoid 114. The first switch 130 is essentially a brush rotation on-off switch. A second switch 132 is provided in a power line 134 to selectively permit an operator of the vacuum cleaning apparatus 12 to activate and deactivate the solenoid 114. When the solenoid 114 is deactivated (when the switch 132 is opened), the actuator arm 136 extends outwardly from the solenoid, permitting the springs 108 to pull the slidable plate 80 downwardly within the valve housing 82 to align the common vacuum passageway 72 with the first exhaust port 66. However, when the second switch 132 is closed, the solenoid 114 draws in the actuator arm 136 to pull the slidable plate 80 upwardly through the valve housing 82 to place the common vacuum passageway 72 in open fluid communication with the second exhaust port 70.

Output from the rectifier 128 is directed to a reversing switch 138. The reversing switch 138 includes connected toggle arms 140 engagable by the plate 80 to change the polarity of the brush drive motor 48, depending on the position of the plate within the valve housing 82. Changing the polarity of the brush drive motor 48 necessarily changes the direction of brush rotation within the chamber 60.

Since it is possible, by simply opening and closing the switch 132, to change the polarity of the brush drive motor 48 instantaneously, it is preferred to provide a delay which permits, upon a switch from one vacuum pathway to the other, the brush 16 to slow or stop its rotation in a first direction before being forcibly rotatably driven in a second direction. This delay is provided by means of a surge suppressor 142, shown as a resistor in FIG. 6.

Of course, if the solenoid 114 is deleted and replaced with a manual means for displacing the slidable plate 80, the circuitry for activating and deactivating the solenoid can be removed, without affecting the remaining circuitry shown. Further, as shown, the system is fully grounded.

In operation, to activate the brush drive motor 48, the first switch 130 is closed. If the second switch 132 is also closed, the solenoid 114 will cause the slidable plate 80 to be situated in its second position so as to align the flexible hose 76 with the second exhaust port 70. In that position, as shown in FIG. 4, the vacuum will be drawn through the second vacuum pathway 24 to collect debris and the like loosened by the brush 16 through the second inlet opening 26. The reversing switch 138 causes the motor 48 to drive the brush 16 in the direction indicated by the arrows 122, to assist in propelling the vacuum cleaning apparatus 12 in a rearward direction.

When the second switch 132 is opened, the solenoid 114 is de-energized, allowing the springs 108 to draw the slidable plate 80 downwardly within the valve housing 82 into its first position. As illustrated in FIG. 3, the flexible hose 76 is aligned with the first exhaust port 66 to permit a vacuum to be drawn through the first vacuum pathway 20 so as to collect debris through the first inlet opening 22. The brush drive motor 48 will reverse, after a short delay which permits the brush to slow to a stop in one direction, prior to being forcibly driven in a second direction.

From the foregoing it is to be appreciated that the improved cleaning head assembly 10 for the vacuum cleaning apparatus 12 permits debris to be vacuumed from either side of the rotatable brush 16, as selected by the operator. By rotating the brush 16 in a direction which assists in propelling the cleaning apparatus 12 over the surface 18 to be cleaned, less manual effort is required to move the cleaning apparatus. Further, by providing a means whereby the vacuum can be selectively drawn on either side of the brush, the need to turn and maneuver the cleaning apparatus is reduced, since adequate cleaning of the surface 18 is accomplished when moving the cleaning apparatus in both the forward and rearward directions.

Although a particular embodiment of the invention has been described in detail for purposes of illustration, various modifications may be made without departing from the spirit and scope of the invention. Accordingly, the invention is to be limited, except as by the appended claims.

We claim:

1. A cleaning head assembly for a vacuum cleaning apparatus, comprising:

a rotatably driven brush carried within and laterally spanning the head assembly, the brush being adapted to loosen and agitate dirt on a surface to be cleaned;

a first vacuum pathway having a first inlet opening adjacent to the surface to be cleaned and laterally spanning the head assembly on one side of the brush, the first vacuum pathway extending from the first inlet opening to a dirt collection zone within the vacuum cleaning apparatus;

a second vacuum pathway having a second inlet opening adjacent to the surface to be cleaned and laterally spanning the head assembly on a second, opposite, side of the brush relative to the first inlet opening, the second vacuum pathway extending from the second inlet opening to the dirt collection zone within the vacuum cleaning apparatus; and means for selectively drawing a vacuum through the first or the second vacuum pathways, and for controlling and changing, if needed, the direction of brush rotation in accordance with the vacuum pathway selected.

2. A cleaning head assembly as set forth in claim 1, including a first vacuum chamber extending through the cleaning head assembly from the first inlet opening to a first exhaust port, a second vacuum chamber extending through the cleaning head assembly from the second inlet opening to a second exhaust port, and a common vacuum passageway extending from the cleaning head assembly to the dirt collection zone, wherein the common vacuum passageway is connectable to the first and the second exhaust ports to, respectively, form a portion of the first and the second vacuum pathways.

3. A cleaning head assembly as set forth in claim 2, wherein the means for selectively drawing a vacuum through the first or the second vacuum pathways includes means for selectively placing the common vacuum passageway in fluid communication with one of the first or the second vacuum chambers.

4. A cleaning head assembly as set forth in claim 3, wherein the means for selectively placing the common vacuum passageway in fluid communication with one of the first or the second vacuum chambers, includes a valve for selectively coupling a proximal end of the common vacuum passageway to one of the first or the second exhaust ports.

5. A cleaning head assembly as set forth in claim 4, wherein the valve comprises a slidable gate valve, and wherein the position of the gate valve determines the direction of brush rotation through the brush rotation controlling means.

6. A cleaning head assembly as set forth in claim 5, wherein the common valve passageway includes a flexible hose connected to the slidable gate valve.

7. A cleaning head assembly as set forth in claim 4, wherein the vacuum cleaning apparatus includes a brush drive motor and a timing belt connecting the motor to rotate the brush, and wherein the means for controlling and changing, if necessary, the direction of brush rotation in accordance with the vacuum pathway selected, controls the brush drive motor in accordance with the position of the valve.

8. A cleaning head assembly as set forth in claim 1, wherein the means for selectively drawing a vacuum through the first or the second vacuum pathways can be switched during operation of the vacuum cleaning apparatus, and wherein the brush rotation controlling means includes a delay which permits, upon a switch from one vacuum pathway to the other, the brush to slow or stop its rotation in a first direction before being forcibly rotatably driven in a second direction.

9. A cleaning head assembly for a vacuum cleaning apparatus, comprising:

a brush carried within and laterally spanning the head assembly, the brush being adapted to loosen and agitate dirt on a surface to be cleaned;

a motor for rotatably driving the brush;

vacuum means communicating with the cleaning head assembly, for sucking up debris and carrying it to a collection zone within the vacuum cleaning apparatus, the vacuum means including a first vacuum pathway having a first inlet opening adjacent to the surface to be cleaned and laterally spanning the head assembly on one side of the brush, and a second vacuum pathway having a second inlet opening adjacent to the surface to be cleaned and laterally spanning the head assembly on a second, opposite, side of the brush relative to the first inlet opening;

means for selectively drawing a vacuum through one of the first or the second vacuum pathways; and means for controlling the motor to rotate the brush in a direction as determined by the vacuum pathway selected.

10. A cleaning head assembly as set forth in claim 9, including a first vacuum chamber extending through the cleaning head assembly from the first inlet opening to a first exhaust port, a second vacuum chamber extending through the cleaning head assembly from the second inlet opening to a second exhaust port, and a common vacuum passageway extending from the cleaning head assembly to the collection zone, wherein the common vacuum passageway is connectable to the first and the second exhaust ports to, respectively, form a portion of the first and the second vacuum pathways.

11. A cleaning head assembly as set forth in claim 10, wherein the means for selectively drawing a vacuum through the first or the second vacuum pathways includes means for selectively placing the common vacuum passageway in fluid communication with one of the first or the second vacuum chambers, wherein the common vacuum passageway placing means includes a slidable gate valve for selectively coupling a proximal end of the common vacuum passageway to one of the first or the second exhaust ports.

12. A cleaning head assembly as set forth in claim 11, wherein the common vacuum passageway includes a flexible hose connected to the slidable gate valve.

13. A cleaning head assembly as set forth in claim 11, wherein the gate valve is slidable between a first position in which the proximal end of the common vacuum passageway is coupled to the first exhaust port, and a second position in which the proximal end of the common vacuum passageway is coupled to the second exhaust port.

14. A cleaning head assembly as set forth in claim 13, including means for biasing the gate valve into its first position.

15. A cleaning head assembly as set forth in claim 14, including means for forcibly displacing the gate valve from its first position to its second position.

16. A cleaning head assembly as set forth in claim 15, wherein the biasing means includes a spring, and wherein the gate displacing means includes a solenoid for moving the gate valve, against the spring, from its first position to its second position.

17. A cleaning head assembly as set forth in claim 9, wherein the brush rotation controlling means includes a delay which permits, upon a switch from one vacuum pathway to the other, the brush to slow or stop its rotation in a first direction before being forcibly rotatably driven in a second direction.

18. A cleaning head assembly for a vacuum cleaning apparatus of the wet, dry and wet/dry types, the cleaning head assembly comprising:

a brush carried within and laterally spanning the head assembly, the brush being adapted to loosen and agitate dirt on a surface to be cleaned;

a motor for rotatably driving the brush;

a first vacuum chamber extending through the cleaning head assembly from a first inlet opening adjacent to the surface to be cleaned and laterally spanning the head assembly on one side of the brush, to a first exhaust port;

a second vacuum chamber extending through the cleaning head assembly from a second inlet opening adjacent to the surface to be cleaned and laterally spanning the head assembly on a second, opposite, side of the brush relative to the first inlet opening, to a second exhaust port;

a common vacuum passageway extending from the cleaning head assembly to a dirt collection zone within the vacuum cleaning apparatus, the common vacuum passageway comprising a flexible hose being connectable to the first and the second exhaust ports to, respectively, define a first vacuum pathway and a second vacuum pathway from the inlet openings to the dirt collection zone;

a slidable gate having a proximal end of the flexible hose connected thereto, wherein the gate is slidable between a first position in which the proximal end of the flexible hose is coupled to the first exhaust port, and a second position in which the proximal end of the flexible hose is connected to the second exhaust port; and means for controlling the motor to rotate the brush in a direction as determined by the vacuum pathway selected, the brush rotation controlling means including a delay which permits, upon a switch from one vacuum pathway to the other, the brush to slow or stop its rotation in a first direction before being forcibly rotatably driven in a second direction.

19. A cleaning head assembly as set forth in claim 18 including a spring for biasing the slidable gate into its first position, and a solenoid for forcibly displacing the gate from its first position to its second position.

20. A cleaning head assembly for a vacuum cleaning apparatus, comprising:

a brush carried within and laterally spanning the head assembly, the brush being adapted to loose and agitate dirt on a surface to be cleaned;

vacuum means communicating with the cleaning head assembly, for sucking up debris and carrying it to a collection zone within the vacuum cleaning apparatus, the vacuum means including a first vacuum pathway having a first inlet opening adjacent to the surface on one side of the brush, and a second vacuum pathway having a second inlet opening adjacent to the surface to be cleaned and laterally spanning the head assembly on a second, opposite, side of the brush relative to the first inlet opening;

a first vacuum chamber extending through the cleaning head assembly from the first inlet opening to a first exhaust port, a second vacuum chamber extending through the cleaning head assembly from the second inlet opening to a second exhaust port, and a common vacuum passageway extending from the cleaning head assembly to the collection zone, wherein the common vacuum passageway is connectable to the first and the second exhaust ports to, respectively, form a portion of the first and the second vacuum pathways;

a gate valve slidable between a first position in which the proximal end of the common vacuum passageway is coupled to the first exhaust port, and a second position in which the proximal end of the common vacuum passageway is coupled to the second exhaust port;

a spring for biasing the gate valve into its first position; and means for forcibly displacing the gate valve from its first position to its second position, the gate valve displacing means including a solenoid for moving the gate valve, against the spring, from its first position to its second position.

* * * * *